US005114538A

United States Patent [19]

Malatesta

[11] Patent Number: 5,114,538

[45] Date of Patent: May 19, 1992

[54] PROCESS FOR SIZING PAPER AND SIMILAR PRODUCTS

[75] Inventor: Francesco Malatesta, Rome, Italy

[73] Assignee: Exxon Chemical Patents Inc., Linden, N.J.

[21] Appl. No.: 367,779

[22] Filed: Jun. 19, 1989

[30] Foreign Application Priority Data

Jun. 21, 1988 [IT] Italy ..... 41627 A/88

[51] Int. Cl.[5] ..... D21H 17/05

[52] U.S. Cl. ..... 162/158; 162/179; 162/183; 162/184; 162/185; 162/186

[58] Field of Search ..... 162/158, 183, 184, 185, 162/186, 175, 179

[56] References Cited

U.S. PATENT DOCUMENTS

| | | | |
|---|---|---|---|
| Re. 29,960 | 4/1979 | Mazzarella et al. | 162/158 |
| 2,045,052 | 6/1936 | Rafton | 91/68 |
| 2,079,846 | 5/1937 | Fair | 92/40 |
| 3,409,500 | 11/1968 | Strazdins et al. | 162/175 |
| 3,560,334 | 2/1971 | Arledter | 162/175 |
| 3,678,035 | 7/1972 | Ray-Chaudhuri et al. | 162/158 |
| 3,930,932 | 1/1976 | Bjorklund et al. | 162/158 |
| 4,040,900 | 8/1977 | Mazzarella et al. | 162/184 |
| 4,152,198 | 5/1979 | Serota et al. | 162/158 |
| 4,568,391 | 2/1986 | von Bonin et al. | 162/158 |
| 4,684,440 | 8/1987 | Penniman et al. | 162/184 |
| 4,721,655 | 1/1988 | Trzasko et al. | 162/175 |
| 4,747,910 | 5/1988 | Mazzarella et al. | 162/158 |

FOREIGN PATENT DOCUMENTS

| | | | |
|---|---|---|---|
| 3239366 | 4/1984 | Fed. Rep. of Germany | 162/158 |
| 52-25102 | 2/1977 | Japan . | |
| 60-209095 | 10/1985 | Japan . | |
| 61-146898 | 7/1986 | Japan . | |
| 61-160495 | 7/1986 | Japan . | |
| 62-230199 | 10/1987 | Japan . | |
| 1492104 | 11/1977 | United Kingdom . | |

OTHER PUBLICATIONS

1985 Alkaline Papermaking, Apr. 17–19, 1985, Denver, CO., TAPPI Press 1985, ISSN, 0738-1190.

1987 Sizing Short Course, Apr. 8–10, 1987, Atlanta, Georgia, TAPPI Press, 1987.

*Primary Examiner*—Peter Chin

*Attorney, Agent, or Firm*—R. A. Maggio; J. B. Murray, Jr.

[57] ABSTRACT

Sizing compounds particularly cyclic acid anhydrides are used as such or in solution with non-aqueous protic and/or protic solvents to mass-size cellulose products such as paper, board, cardboard and similar cellulose and synthetic fibre products. In a preferred embodiment, the cyclic acid anhydrides or their solutions in inert solvents are introduced into the wet-end of the paper machine at a position where the paper slurry is in a highly turbulent state so that they are immediately homogenized and reacted with the cellulose stock.

25 Claims, No Drawings

PROCESS FOR SIZING PAPER AND SIMILAR PRODUCTS

This invention relates to a process for sizing paper or similar products, such as board, cardboard etc., based on cellulose or synthetic fibres.

Paper, board, cardboard and other similar products are produced by first dispersing the cellulose or synthetic fibres in large quantities of water and the dispersion passed to a paper making machine where the water is removed to form the continuous paper web.

According to the nature of the fibres, the type of paper or board to be produced etc, the product is treated with various chemicals which may be injected into the aqueous dispersion of the fibres. One particular treatment common to most paper making processes is sizing.

Sizing of paper is well known, two typical sizing materials are alkyl-ketene dimers and alkenyl succinic anhydrides. These products are generally used in emulsion form as described in, for example, Japanese Patent Publications 62-231099; 61-146898; 61-160495; 52-25102; 60-20905. Whilst the present invention is concerned with sizing in general it is particularly concerned with sizing with alkenyl succinic anhydrides.

United Kingdom Patent 1492104 describes the use of polyoxyalkylene alkyl or arylalkyl ethers, or the corresponding mono- and di-esters derivatives to produce emulsions of cyclic acid anhydrides with a low input of shear energy. Such emulsions are used to disperse intimately the anhydrides into the cellulose stock to produce sized paper. The sizing emulsion can be produced in-situ, within the cellulose stock, or prior to introduction into the cellulose stock. The emulsions are preferably prepared in the presence of cationised stabilisers such as cationized starches, polyaminoethyl acrylate resins, polyamide resins having free amino groups, reacted or not with epichlorohydrin etc.

The main function of these cationic stabilizers is to charge positively the emulsion's particles favouring their absorption by Coulombic attraction on the negatively charged surface of the cellulose fibres.

The use of nitrogen and/or oxygen containing emulsifiers to produce emulsions of cyclic acid anhydride emulsions, in the presence of cationic stabilizers, with a low shear energy input is generally carried out using a concentration of 2.0 to 10.0% emulsifier based on the anhydride. Concurrently, typically 1 to 5 parts of cationic stabilizers are used for 1 part of anhydride.

The emulsions obtained are chemically unstable in water. As a consequence, emulsion particles with submicron diameters are quickly hydrolised. On the contrary, emulsions particles of diameter above 3–4 microns, with too low surface-to-mass ratios lack enough Coulombic attraction to be rapidly deposited onto the cellulose and thus remain suspended in the process water used in the paper making.

Consequently, they are recycled continuously with the process water and are eventually hydrolysed which not only wastes sizing compounds, but causes paper machine running problems. The emulsion-based sizing technology further produces poorly sized paper due to re-wetting phenomena, caused by the emulsifier, low sizing yields and foaming.

Re-wetting results from the presence of residual emulsifier in the cyclic acid anhydride absorbed on the cellulose fiber's surface. The emulsifier's polar groups, spread over the surface of the anhydride particle, attract water to the surface thus favouring the anhydride hydrolysis rather than its reaction with the hydroxy groups in the cellulose.

Moreover, the presence of residual emulsifier on the finished paper creates undesirable water affinity in the paper and the consequent decrease of the hydrophobic character of the paper produced by sizing. These difficulties are not eliminated by reducing the emulsifier concentration to below 1.0% based on the anhydride and by using high shear mixers in the presence of 1 to 5 parts of a cationic stabilizer for 1 part anhydride. Even by using turbine-type mixers (rotating in the range 10000 to 20000 RPM) it is difficult to control the particle's diameter distribution both in the sub-micron and 3 to 4 micron ranges. The anhydride molecular weight and the structure of its alkenyl chain have little influence on the above behaviour.

High-shear emulsification techniques based on turbine pumps with inlet-outlet pressure drops as high as 8 to 10 kg/cm$^2$ are needed to obtain emulsion particle diameter distributions for best sizing result. However, the high-shear produced emulsions are characterized by poor stability and they tend to phase out quickly.

Producing paper, with the use of cyclic acid anhydride emulsions for sizing, requires some additional skills not generally available to the paper industry and extra caution. Also, operational costs are higher and foaming can cause problems.

Foam, with its large air-liquid interface, favours evaporation of the recycle liquids with the formation of fatty deposits both on the paper and in the water recycle tank. These can also cause paper machine running problems. Thus, more frequent cleaning operations may be needed which tend to disrupt the process and to increase the production costs. A further negative cost item is represented by the use of the emulsion's cationic stabilizers.

A number of problems encountered by the paper industry when using emulsions of cyclic acid anhydrides in sizing paper are described in:

1987 Sizing Short Course, Apr. 8-10 1987, Atlanta, Ga., TAPPI Press 1987.

1985 Alkaline Papermaking, Apr. 17-19, 1985, Denver, Colo., TAPPI Press 1985, ISSN 0738-1190.

Thus, although sizing paper may be achieved by using emulsified reactive synthetic products, the disadvantages are sizing compound waste due to hydrolysis, poorly sized paper due to re-wetting phenomena, low sizing yields, foaming, fatty deposits formation in the water recycle tank and paper machine running problems.

In addition paper production processes based on sizing with emulsified products is less economic due to:

the need of emulsifiers and of the emulsion's stabilizers.

a larger use of sizing compounds to compensate for the lower sizing yields, resulting from the size's hydrolysis, and the ensuing lower hydrophobic character of the paper.

the need of more frequent cleaning operations leading to an increased number of process disruptions.

the need of high-shear turbine pumps.

It is the main purpose of this invention to reduce or eliminate the technical and cost problems associated with the paper sizing with emulsified sizing compounds especially those based on cyclic acid anhydrides.

An aim of this invention is to develop a method to contact the sizing compounds and the cellulose stock which predetermines accurately and with reproducibility the contact time and the sizing compound's particle diameter as a function of other relevant process parameters (for instance, type of cellulose, paper stock degree of freeness, type of mineral charges, temperature of the drying section, etc).

Another aim is to develop a method, to contact the synthetic sizing compound with the cellulose stock which reduces hydrolysis of the sizing compound during its residence period in the process water.

It is also desirable that the method to contact the synthetic sizing compound with the cellulose stock be readily adaptable to existing plants producing paper, cardboard, etc.

These and other objectives, which will become evident later, are obtained, in the production of paper, board, cardboard, etc., with a sizing process comprised of the following steps:

production of a cellulose stock water slurry.

cationization of such slurry.

dispersing the synthetic size, neat or in solution with non active compounds such as gases or solvents, in form of fine droplets into the cellulose stock before, during or after the paperweb formation whether or not said paperweb is dry or wet.

drying the paperweb.

The cationised slurry is generally treated with mineral charges prior to mixing with the size. Such mineral charges, for example, can be calcium carbonate, kaolin and the like, in the preferred concentration range of 10 to 50% on dry fibers, and can be added either on-line or in the cellulose stock preparation tubs.

Further benefits of the use of the process of the invention will become apparent in the detailed description of some procedures needed to implement it. Such procedures are described to explain the invention and are not meant to be a limitation thereof.

According to the preferred procedure to implement the invention, the reactive synthetic sizing compound is continuously dispersed in the form of fine droplets into the wet-end of the paper machine, preferably in places where the cellulose stock water slurry is under high turbulence, to obtain rapid and complete contact of the sizing compound with the paper stock. If necessary turbulence can be controlled by the provision of baffles and stirrers in the flow of the slurry.

The sizing compound dispersion is conveniently obtained with a 360° spraying nozzle, immersed into the paper stock, which produces droplets of predetermined dimensions (e.g. 0.1 to 10 microns up to about 150 microns) and a predetermined particle diameter distribution. The spraying nozzle type and spraying angle may change depending on the type of paper machine and on the place, within the paper machine, where it will be positioned for best result. The number of spraying nozzles used may be chosen according to the type of paper machine and the type of paper or paper product being manufactured.

The reactive synthetic sizing compound may be delivered to the spraying nozzle with a pressurized piping system. The spraying pressure can be generated with metering micro-pumps. Alternatively, the compound may be delivered to the spraying nozzle from storage tanks which are pressurized with an inert dry gas, and the compound can be metered with calibrated microvalves.

The storage tanks, the piping system, the nozzles, the valves and the metering micro-pumps can be thermostated with water at selected temperatures (e.g. 5°-100° C.) to avoid metering problems, at the prevalent low rates of treatment, due to temperature variations of the metering unit.

Thermostating would be of particular interest to obtain determined viscosity values of the sizing compound to produce droplets with predetermined diameters when exiting the spraying nozzle. The viscosity control could become an essential feature if reactive sizing compound, solid or highly viscous at room temperature, are used. For instance, this could be the case with cyclic anhydrides substituted with palmityl (or heavier) or linear rather than branched groups or the use of alkyl ketene dimers.

The sizing product pressurization in the storage tank can be obtained, at or about room temperature, with dried gases such as air, nitrogen, argon, methane, propane, butane, chlorofluoro hydrocarbons, carbon dioxide, nitrogen protoxide. Some of said gases are soluble in the reactive sizing compounds at the storage temperature.

The absorption of the sizing compound droplets on the cellulosic fibres is aided by the cationizing treatment the fibres have undergone either on-line or in the paper stock preparation tubs. Such cationization is a standard technique in paper production to favour the retention of wet-strength resins, of mineral charges, etc, which otherwise would be in large part lost. The cationization is generally carried out with long chain fatty amines, synthetic polymers containing amines, cationic modified starches, polyamide-amine resins and other cationized products. Typically 0.02 to 3.50 wt % of cationizing agent based on the weight of dry fibre is used.

The contact time with the process water of the reactive synthetic sizing compound in dispersed droplet form is very small, depending on the turbulence of the machine wet-end and on the cationizing treatment of the cellulose fibre. These factors can be varied at will until high deposition rates of the size droplets on the fibres are achieved.

The combined action of the extremely low contact time with the process water and the natural hydrophobicity of the sizing compound prevent its hydrolytic degradation and the resulting waste. Moreover, by lowering the droplets diameter to very low values, the interactions with the cellulose fibres and the sizing compound absorption can be improved thus increasing the sizing yield to a level beyond that which can be achieved with the current emulsion technology.

In another procedure to implement this invention, the solutions of certain gases, such as methane, propane, butane, chlorofluoro hydrocarbons, carbon dioxide, etc., in the synthetic sizing compound are sprayed in form of fine droplets directly into the wet-end of the paper machine or onto the formed paper web before the machine drying section, or in the size press.

The nozzle(s), or any similar device, connected with a pressurized piping system to the storage tank containing the sizing compound solution, may be used to disperse the sizing compound solutions into the cellulose-water slurry. The gas evaporates out of the system, or it is dissolved by the process water, favouring the droplets dispersion without affecting in any other way the paper production process.

Another important function of the dissolved gas is to protect the surface of the droplets from water's hydrolytic action, and to produce in-situ a fresh surface on the droplets during evaporation of the gas or its solution into the process water. When the droplets production occurs in air, according to one of the preferred methods, the gas dissolved in the sizing compound evaporates directly into the atmosphere.

A range of gas-sizing compound compositions may be used. A preferred composition could be experimentally determined because it may depend from the type of paper produced in a given machine and from the process parameters. In general, the dissolved gas concentration may be in the range 20 to 50% on the sizing compound although for economic reasons it is preferable that gas concentrations be kept in the range 1 to 19% if the cost factor is very important. The sizing compound gas solutions could also be obtained by previously mixing gas types with low and high solubility into the sizing compound, such as nitrogen and carbon dioxide, nitrogen and methane.

In another procedure, the reactive synthetic sizing compound is first dissolved in an anhydrous, aprotic, water-soluble, inert solvent. The solution, is sprayed with one or more nozzles as fine droplets directly into the water-cellulose slurry at the paper machine wet-end. In this case, the inert solvent is dissolved by the process water thus protecting the reactive sizing compound droplets from water's hydrolytic action and generating in-situ a fresh surface in the presence of cellulose.

The presence of inert gases dissolved in the aprotic solvent, as previously specified (for example carbon dioxide), is claimed also for this type of procedure.

Examples of useful aprotic compounds include ketones, esters, ethers, aromatic and aliphatic hydrocarbons, (for example acetone, methylethyl ketone, acetonyl acetone, methyl acetate, ethylene glycol diacetate, dioxane, etc). A range of solvent concentrations in the solutions with the sizing compound can be considered. The preferred composition will be determined by experiment depending on the process parameters. Cost considerations would indicate that solvent concentrations in the range 1 to 19% may be preferred to concentrations in the range 20 to 50% or higher, also to avoid the solvents accumulation in the water recycle system.

In another preferred procedure to implement the invention, the reactive sizing compound is dissolved in an anhydrous, protic, water soluble compound immediately before being sprayed and transformed in fine droplets.

Preferred concentrations of the protic anhydrous solvent with the reactive sizing compound are as previously disclosed in the case of the aprotic solvents. Classes of such solvents include alcohols, etheralcohols, esteralcohols (e.g. methyl alcohol, ethyl alcohol, 2-butoxyethanol, ethylene glycol monoacetate, 2-(2 butoxyethanol), etc.

Subsequent to the addition of the sizing compound to the paper stock into the paper machine wet-end in the concentration range of 0.005 to 2.0% weight on dry fibres, the paper web is dried by heating to temperatures in the range 90° to 120° C. thus favouring the reaction between the reactive sizing compound and the hydroxyl groups of the cellulose. This may be performed by the heated cylinders which provide also the pressure (e.g. 1 to 15 kg/cm) needed to impregnate the paper web surface and thickness with the reactive sizing compound.

According to an alternative procedure to implement the invention, the synthetic sizing compound is sprayed onto the formed paperweb with one or more nozzles having small spraying angles. They could spray in the direction of one side of the paperweb, or in the opposite side or on both sides simultaneously.

With this technique, the spraying can be extended to the whole surface of the paperweb or can be limited to some parts of the surface, either when still wet or in size press, or in both positions.

When spraying in size press, the final drying cylinders used to dry the paper should exert enough pressure and reach a temperature high enough to ensure both the impregnation by the sizing compound of the paper wet thickness and the reaction with the hydroxyl group of the cellulose.

When the sizing compound is applied in the size press, its concentration could reach values above 2% weight on dry fibres. Higher concentrations are possible with consequences on the cost.

In the case of the size press treatment, the heated cylinders must be at temperature and pressure levels high enough to favour the reaction between sizing compound and cellulose's hydroxyl groups.

A certain period of time will be required to achieve such reaction when the sizing compound concentration is in the higher ranges.

The preferred synthetic reactive sizing compounds are cyclic acid anhydrides of the general

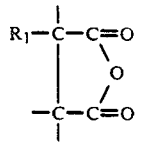

where $R_1$ is an organic hydrophobic group (e.g. having from 5 to 80 carbon atoms selected from the group consisting of alkyl, alkenyl, cycloalkyl substituted with alkyl, or alkenyl; and aralkyl substituted with alkyl, alkenyl). More preferred are the liquid cyclic acid anhydrides in which $R_1$ is a branched chain $C_8$–$C_{16}$ alkenyl group.

Typical examples of cellulose that may be treated with the sizing compounds are derived from hardwoods and softwoods, bleached or not bleached, semi-chemical, groundwood and combination thereof. Synthetic rayon or regenerated cellulose fibres may also be used as well as waste paper and cardboard.

The present invention may be applied to any sizing material examples of which include acyl halides, cyclic acid anhydrides, alkyl ketene dimers, isocyanates, alkyl amino chlorides, urea derivatives, carbonic acid chlorides, chlorosulphonic and chlorophosphoric acid amides such as those described in the 1987 Sizing Short Course Reference mentioned above. Where the materials are solids it may be necessary to apply them as solutions.

The following examples illustrate the present invention.

Cellulose water slurry to produce handsheets was prepared using the following steps.

A) Bleached sulphate cellulose 34°-36° SR (60% hardwood, 40% softwood) is slurried in tap water at 21.3 grams per liter. 470 g of the slurry are treated with up to 0.5 wt % of cationized potato starch and with up to 0.25% of aluminium sulphate hydrated, stirred at 300

RPM for 5 minutes and then left unstirred for 10 minutes.

B) The starch solution is freshly prepared by cooking 50 g starch in 300 ml water and diluted then with cold water up to 930 g followed by dilution to 0.1% solids.

C) After 10 minutes standing, the 470 g of treated cellulose slurry are diluted to 4 liters to 0.25% cellulose concentration the pH being adjusted to 6.80; under stirring with a blade stirrer at 1000 RPM, the 4 liters slurry is treated with variable amounts of the sizing compounds under investigation; when the addition of the sizing compound is finished the stirring is decreased to 300 RPM and 0.000–0.0400% cationic polyacrylamide is added. Stirring is continued for another 5 minutes and then discontinued.

D) Handsheets are made in a Frank, handsheet machine to obtain handsheets of grammage about 100 g/m$^2$; the handsheets are dried in an oven at 105° C. for 60 minutes. The 60 "COBB determinations are made after conditioning the handsheets for 12 hours at 22° C. and 50% RH.

E) All concentrations in the examples refer to weights on dry cellulose.

F) The following cyclic anhydrides were tested as sizing compounds; compound A - succinic anhydride substituted with a $C_{12}$ mono-olefinic chain, compound B succinic anhydride substituted with a $C_{16-18}$ mono-olefinic chain.

EXAMPLE 1

A solution of 25 parts by weight of dry acetone and 75 parts of the sizing compound A was prepared, stoppered in a flask and stored in a nitrogen-filled dry box.

The bleached sulphate cellulose previously described is treated and cationized as previously described in steps A and B. 0.04 ml of the acetone solution of sizing compound A are measured with a microsyringe and injected as a spray subdivided in fine droplets into the vortex generated in 470 grams of the cellulose slurry diluted to 4 liters as described in step C. After the injection, the stirring was decreased to 300 RPM and 0.0375 parts of cationic polyacrylamide on 100 parts of dry cellulose were added as a water solution. Stirring was discontinued after 5 minutes. The sizing compound was 0.3 wt % based on dry cellulose. The handsheets were prepared, dried and conditioned as previously described. The 60" COBB values are F(elt) 20 and W(ire) 19 and the handsheets had a grammage of 100 indicating excellent sizing.

The fine droplets of sizing compound A, produced directly with the microsyringe into the turbulent cellulose slurry, are further reduced in diameter by the acetone dissolution in the excess water. Further, such a dissolution produces a fresh surface on the droplets of the sizing compounds in the presence of cellulose's cationized fiber surface favouring the deposition by Coulombic attraction and practically eliminating all contact with the water phase and the consequent product hydrolysis.

EXAMPLE 2

A 50-50 by weight, dry acetone-sizing compound A solution is prepared, stoppered in a flask and stored in a nitrogen-filled dry box. Bleached sulphate cellulose of the composition and amount previously described is treated and cationized as previously described in steps A and B. 0.06 ml of the acetone solution are introduced in the cellulose slurry as described in Example 1. The sizing compound A added corresponds to 0.3% weight on dry cellulose. The handsheets, dried and conditioned as previously specified, have a 60" COBB value of F 17 W 17 indicating an excellent sizing. Grammage was 93.

This example indicates that doubling the acetone content of the solution of the reactive synthetic sizing compound does not have negative effects on the sizing. It has been confirmed that acetone is inert and that its function may be only limited to generate smaller, not hydrolised droplets with a larger contact surface, as a result of its dissolution in the process water.

EXAMPLE b 3

Example 2 was repeated in the same conditions except that instead of adding the acetone solution of sizing compound A. 0.03 ml of neat acetone are only added. The addition is made according to the technique previously indicated. The handsheets, produced as described, were completely unsized as indicated by a failed attempt to measure COBB" 60, the paper having no hydrophobic character.

This example confirms that acetone has no sizing activity and does not interfere with the paper sizing process based on cyclic acid anhydrides.

EXAMPLE 4

Example 2 is repeated replacing the sizing solution with a 50% solution of sizing compound B in dry atone. All other conditions and methodology were identical. Also in this case the sizing compound added corresponds to 0.3% weight on dry cellulose. The handsheets, prepared and conditions as previously indicated had a 60" COBB value of F 17 W 18 indicating excellent sizing. Grammage was 100.

This example indicates that sizing is unaffected by the length of the mono-olefinic chain, present in the cyclic acid anhydride, when using the treatment of this invention.

EXAMPLE 5

Bleached sulphate cellulose, of the composition and amount previously described, is treated and cationized as indicated. After dilution of three separate amounts of the treated cellulose, as described in step C), variable amounts of sizing compound A were measured with a microsyringe and injected into the vortex of a stirrer (rotating at 1000 RPM) immersed in the cellulose slurry. The addition of 0.0375% weight on dry cellulose of cationic polyacrylamide (as water solution) follows after reducing the stirrer rotation speed to 300 RPM. After 5 minutes the stirring was stopped. The handsheets are prepared and dried as previously indicated. The following results were obtained.

| Sizing Compound | 60" COBB | | Grammage |
|---|---|---|---|
| A % on dry fibres | F | W | g/m$^2$ |
| 0.3 | 20 | 20 | 94 |
| 0.2 | 19 | 20 | 103 |
| 0.1 | 22 | 23 | 105 |

The results indicate that the addition of neat sizing compound A as a fine dispersion of small droplets directly into the stirred cellulose slurry under stirring produces highly sized paper at low treat rates.

EXAMPLE 6

Example 5 was repeated with sizing compound B under the same experimental conditions with the following results.

| Sizing Compound B % on dry fibres | 60" COBB F | 60" COBB W | Grammage g/m² |
|---|---|---|---|
| 0.3 | 18 | 17 | 96 |
| 0.2 | 18 | 20 | 99 |
| 0.1 | 21 | 22 | 103 |

which confirm those of Example 5, that no negative effect on the sizing of paper are observed if the sizing compound's mono-olefinic chain length is increased.

EXAMPLE 7

This example indicates the influence of cationizing cellulose with cationized potato starch and hydrated aluminium sulphate before the sizing compound addition.

| Cellulose cationization | | Polyacrylamide post- | 60" COBB | |
|---|---|---|---|---|
| Al sulphate % wt | Starch % wt | treatment % wt | F | W |
| 0.00 | 0.00 | 0.00 | no sizing | |
| 0.25 | 0.50 | 0.00 | 22 | 19 |

The result indicates the cellulose's pre-cationization is necessary to obtain good sizing.

EXAMPLE 8

Example 5 is repeated using 0.2% sizing compound B and variable amounts of cationized starch to pre-cationize, all other concentrations being unchanged.

| Cellulose treatment cationized starch % wt | 60" COBB F | 60" COBB W |
|---|---|---|
| 0.50 | 19 | 20 |
| 0.30 | 27 | 28 |
| 0.10 | 27 | 26 |

The result indicates that considerable savings are possible in the production of paper by sizing with neat compound B. This goal is achieved by reducing the amount of starch in the pre-cationization of cellulose and by eliminating the starch as the emulsion stabilizer.

EXAMPLE 9

In this Example all weights refer to dry cellulose. 1.5 ton of bleached sulphate cellulose (60% hardwood, 40% softwood) of freeness 31 degrees SR, at a concentration of 21.6 grams/liter in average hardness process water, is treated with 0.5% cationized potato starch (Roquette Fr. HICAT 180 brand) and with 0.25% aluminium sulphate hydrated (alum).

The pretreated paper stock is fed to a SICMA paper machine, fitted with a Fourdrinier net of width 0.56 meters and a series of 22 steam heated drying cylinders, running at 40 meters per minute and producing about 100 kg paper per hour. The machine was run to produce paper of grammage about 80–85 grams/square meter.

25% calcium carbonate (Craie Micronic 0 brand) slurried in water is metered on-line into the paper stock before its dilution with white water upstream of the fan pump before the machine head box. The paper stock pH after calcium carbonate addition is in the range 7.2–7.6.

A Millipore-Waters Mod.510 precision micropump, connected to a stainless steel 150 microns spraying nozzle with stainless steel capillary tubing, is used to meter at ambient temperature neat alkenyl succinic anhydride (ASA) having a branched $C_{12}$ alkenyl side chain. The pumping pressure is in the range 30–50 kg/cm.

The nozzle is located within the diluted paper stock pipe entering the fan pump. As a result of the turbulence prevailing in the paper stock within the fan pump, the cyclic anhydride spray exiting the nozzle is rapidly dispersed into and homogenised with the paper stock.

0.25 and 0.2% ASA are introduced into the paper stock in 2 successive experiments where the only variable is the ASA concentration, all other machine running parameters being unchanged 0.038% polyacrylamide (Zschimmer & Schwartz F04550BPM brand) is added to the ASA treated paper stock as a flocculant just before it enters the head box.

The paper web is dried in the machine drying section, whose steam-heated cylinders are programmed to reach temperatures in the range 50–110 degrees Celsius, before being wound up.

The following paper machine parameters are observed in a 14 hour operation during which about 1.3 tonnes of commercially sized paper are produced using the sizing technique of the present invention by spraying neat cyclic acid anhydride with a nozzle directly into the paper stock.

| ASA wt | 0.25 | 0.2 |
|---|---|---|
| Head box paper stock conc. g/l | 3.56 | 3.67 |
| First pass retention all solids % | 92.70 | 92.40 |
| First pass retention $CaCO_3$ % | 75.70 | 76.90 |
| Ashes at 425 degrees Celsius % | 16.40 | 15.50 |
| Zeta potential white water mV | +8 | +6 |
| Felt Cobb 60" machine | 23 | 24 |
| Grammage machine g/m² | 80 | 83 |

After conditioning for 24 hours at 22 degrees Celsius and 50% relative humidity, the paper is tested giving the following result.

| Paper sized with ASA at 0.2% | | |
|---|---|---|
| Grammage g/m² | | 84.7 |
| Reciprocal density cm³/g | | 1.29 |
| Burst index | | 2.05 |
| Whiteness Elrepho % | Wire | 83.3 |
| | Felt | 83.2 |
| Smoothness Bekk sec. | Wire | 41.0 |
| | Felt | 42.0 |
| Cobb 60" g/m² | Wire | 21.3 |
| | Felt | 21.7 |

The result indicates that addition by spraying of neat ASA, directly into the paper stock produces paper having normal commercial characteristics.

EXAMPLE 10

Example 9 is repeated in all its details except that equivalent amounts of a cyclic acid anhydride (Roquette Fr. Fibran 71 brand), having a $C_{16}$–$C_{18}$ alkenyl side chain, are used. Also in this Example the acid cyclic anhydride is sprayed neat with a nozzle directly into the paper stock upstream of the fan pump.

The following paper machine parameters are observed in a 13 hour paper making operation during which about 1.2 tonnes of commercially sized paper are produced.

| FIBRAN wt % | 0.25 | 0.2 |
|---|---|---|
| Head box paper stock conc. g/l | 3.52 | 3.48 |
| First pass retention all solids % | 92.40 | 91.00 |
| First pass retention $CaCO_3$ % | 75.50 | 69.30 |
| Ashes at 425 degrees Celsius % | 14.20 | 14.80 |
| Zeta potential white water mV | −6 | −3 |
| Felt Cobb 60" machine | 20 | 22 |
| Grammage machine g/m$^2$ | 83 | 83 |

After conditioning for 24 hours at 22 degrees Celsius and 50% relative humidity, the paper is tested giving the following result.

| Paper sized with FIBRAN 71 at 0.25% | | |
|---|---|---|
| Grammage g/m$^2$ | | 83.5 |
| Reciprocal density cm$^3$/g | | 1.30 |
| Burst index | | 2.49 |
| Whiteness Elrepho % | Wire | 83.4 |
| | Felt | 83.3 |
| Smoothness Bekk sec. | Wire | 38.0 |
| | Felt | 42.0 |
| Cobb 60" g/m$^2$ | Wire | 20.2 |
| | Felt | 21.0 |

The result indicates that addition by spraying of neat cyclic acid anhydrides directly into the paper stock produces paper having normal commercial characteristics independent of the length of the alkenyl side chain attached to said cyclic acid anhydrides.

I claim:

1. A process for sizing paper products derived from aqueous-based cellulosic fiber paper stock adapted to form a web comprising:

(1) treating a cellulose fiber water slurry paper making stock with a cationizing agent to form a cationized paper making stock;

(2) providing a non-emulsified sizing agent reactive with cellulose consisting essentially of neat, liquid, reactive sizing material or unreactive sizing material dissolved in an inert, anhydrous, water soluble, organic, protic or aprotic solvent, wherein said reactive sizing material comprises at least one member selected from the group consisting of acyl halide, cyclic acid anhydride, alkyl ketone dimer, isocyanate, alkyl amino chloride, carbonic acid chloride, chlorosulphonic acid amide, and chlorophosphoric acid amide;

(3) contacting and applying to at least a portion of the fiber surface of said cationized appear marking stock:

(a) before, during or subsequent to forming the cationized paper making stock into a web; and (b) with a fine droplet non-emulsified spray of said sizing agent for a time and in a manner sufficient to provide absorption by the fibers of said paper making stock, of at lest 0.005 weight % non-emulsified sizing material based on the weight of dry cellulose fiber; and (4) reaction the sizing material applied in accordance with step (3) with the cellulose fibres of the paper making stock.

2. The process of claim 1, wherein the cellulose fiber water slurry paper making stock is treated with an amount of mineral charges selected from calcium carbonate, and kaolin sufficient to apply from 10 to 50% on dry fibres.

3. The process of claim 1 wherein the cationizing agent is selected from the group consisting of: long chain fatty amines, synthetic polymers containing amines, cationic modified starches, polyamide-amine resins, cellulose modified with amino groups, and hydrated aluminum sulphate.

4. The process of claim 1 wherein contact of the sizing agent with the cationized appear making stock is conducted using sprayed droplets obtained from at least one nozzle, disposed directly into said paper making stock at places of high turbulence.

5. The process of claim 1, wherein the sizing material is cyclic acid anhydride of the general formula

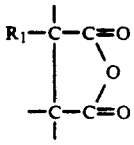

where $R_1$ is a hydrophobic hydrocarbyl group having from 5 to 80 carbon atoms selected from the group consisting of alkyl, alkenyl, cycloalkyl substituted with alkyl, or alkenyl, groups; and aralkyl substituted with alkyl, alkenyl groups.

6. The process according to claim 1 wherein the paper making stock is contacted with an amount of sizing agent sufficient to apply to said paper making stock from 0.005 to 2.0% based on the weight of dry cellulose fibers.

7. The process according to claim 1 wherein the sizing agent is provided as a solution of sizing compound in inert solvent.

8. The process according to claim 7 where the solvent is present in the sizing solution at a concentration of from 1 to 50% wt of the solution.

9. The process according to claim 7 wherein the solvent of said sizing solution is: (a) selected to evaporate from or be dissolved by the process water of the cationized paper making stock upon completion of contacting step (3); and (b) selected from the group consisting of ketones, esters, linear ethers, cyclic ethers, and alcohols.

10. The process according to claim 1 in which inert gas is dissolved in the sizing agent.

11. The process according to claim 10 wherein said gas evaporates from or is dissolved by the process water of the cationized paper making stock upon completion of contacting step (3).

12. A process according to claim 1 wherein polyacrylamide flocculant is present in the cellulose fiber water slurry paper making stock in an amount of up to 0.5% wt.

13. The process according to claim 1 where reaction of step (4) is conducted by heating paper web after treatment with said sizing agent under a pressure of about 1 to 15 kg/cm at temperatures in the range 85° to 120° C.

14. The process according to claim 1 wherein the cellulose fiber paper stock is derived from hardwood or softwood cellulose, bleached or unbleached, semi-chemical cellulose, groundwood and combinations thereof, natural and synthetic cellulose fibers, and waste paper and cardboard having a freeness of from 20° to 60° SR.

15. The process of claim 1 wherein contact of the sizing agent with cationized paper making stock is conducted by applying said sizing agent to at least one surface of the web, after it is formed, through at least one spray nozzle.

16. The process of claim 1 wherein the temperature of the sizing agent provided for use in contacting step 3 is from 5° to 100° C.

17. The process of claim 1 wherein the droplet diameter of the sizing spray is controlled to range from 0.1 to 10 microns.

18. The process of claim 5 wherein $R_1$ to $C_8$ to $C_{16}$ alkenyl.

19. The process of claim 1 wherein the reactive sizing material is dissolved in aprotic solvent selected from the group consisting of ketone, ester, ether, aromatic, and aliphatic, hydrocarbons.

20. The process of claim 1 wherein the reactive sizing material is dissolved in a protic solvent selected from the group consisting of alcohol, ether alcohol, and ester alcohol, hydrocarbon.

21. The process of any one of claims 5, 15, 16 and 22 wherein the sizing agent is pressurized with inert gas.

22. The process of claim 1 wherein contact of the sizing agent with the cationized paper stock is conducted after said paper stock has been formed into a web and the reaction of step (4) is conducted by heating and thereby drying said web at a temperature of 90° to 120° C.

23. The process of claim 1 wherein at least one of steps (3) and (4) are conducted in a manner sufficient to impregnate the cellulose fibers of paper stock with sizing material.

24. The process of claim 23 wherein said heating is conducted with heated press cylinders maintained at a pressure sufficient to impregnate the web surface and thickness with sizing material.

25. The process of any one of claims 2 to 4, 5 to 11, 12 to 18, 19, 2D and 22 to 24 wherein the inert solvent comprises aprotic solvent selected from the group consisting of acetone, methylethyl acetone, acetonyl acetone, methyl acetate, ethylene glycol diacetate, and dixoane, and when protic is selected rom the group consisting of methyl alcohol, ethyl alcohol, 2-butoxyethanol, ethylene glycol monoacetate, and 2-(2-butoxyethanol).

* * * * *